US012352174B2

(12) United States Patent
Raghuvaran et al.

(10) Patent No.: US 12,352,174 B2
(45) Date of Patent: Jul. 8, 2025

(54) FAN RETENTION MEMBER FOR SUPPORTING A BLADE PLATFORM OF A FAN ASSEMBLY

(71) Applicant: General Electric Company, Schenectady, NY (US)

(72) Inventors: Vaishnav Raghuvaran, Bengaluru (IN); Bhaskar Nanda Mondal, Bengaluru (IN); Gary Willard Bryant, Jr., Loveland, OH (US)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 18/308,105

(22) Filed: Apr. 27, 2023

(65) Prior Publication Data

US 2024/0271528 A1 Aug. 15, 2024

(30) Foreign Application Priority Data

Feb. 10, 2023 (IN) ..... 202311008703

(51) Int. Cl.
*F01D 11/00* (2006.01)
*F01D 5/30* (2006.01)

(52) U.S. Cl.
CPC ..... *F01D 11/008* (2013.01); *F01D 5/3007* (2013.01)

(58) Field of Classification Search
CPC ..... F01D 11/008; F01D 5/3007
See application file for complete search history.

(56) References Cited

U.S. PATENT DOCUMENTS

| | | | | |
|---|---|---|---|---|
| 3,294,364 | A * | 12/1966 | Stanley | F01D 5/3007 416/210 A |
| 5,123,813 | A | 6/1992 | Przytulski et al. | |
| 5,167,489 | A * | 12/1992 | Wadia | F02K 3/04 415/218.1 |
| 5,486,095 | A | 1/1996 | Rhoda et al. | |
| 6,447,250 | B1 | 9/2002 | Corrigan et al. | |
| 8,425,192 | B2 * | 4/2013 | Hoyland | F01D 11/008 416/214 A |
| 9,399,922 | B2 | 7/2016 | Lamboy et al. | |
| 10,458,425 | B2 | 10/2019 | Boyer et al. | |
| 10,557,361 | B1 * | 2/2020 | Karkos | B32B 5/024 |
| 10,605,117 | B2 | 3/2020 | Wang et al. | |
| 10,738,630 | B2 | 8/2020 | Li et al. | |
| 2003/0012654 | A1 * | 1/2003 | Strassberger | F01D 5/3007 416/219 R |

(Continued)

*Primary Examiner* — Courtney D Heinle
*Assistant Examiner* — Michael K. Reitz
(74) *Attorney, Agent, or Firm* — Dority & Manning, P.A.

(57) ABSTRACT

A fan assembly includes a disk having a disk forward surface, a disk aft surface, and a radially outer surface. The disk defines a plurality of disk posts and a plurality of disk slots in the radially outer surface. At least one of the plurality of disk posts includes a post slot. The fan assembly also includes a fan having a plurality of fan blades and a plurality of platforms extending between adjacent fan blades of the plurality of fan blades. Each of the plurality of fan blades is received within one of the plurality of disk slots via a respective blade root. Further, the fan assembly includes at least one fan retention member having a body portion and a protrusion extending from the body portion. The protrusion is received within the post slot such that the at least one fan retention member supports one of the plurality of platforms.

2 Claims, 9 Drawing Sheets

(56) References Cited

U.S. PATENT DOCUMENTS

| | | | | |
|---|---|---|---|---|
| 2013/0266447 | A1* | 10/2013 | Evans | F01D 11/008 416/191 |
| 2014/0186187 | A1* | 7/2014 | Lamboy | F02K 3/06 29/889.2 |
| 2017/0350413 | A1* | 12/2017 | Boyer | F04D 29/023 |
| 2019/0055847 | A1* | 2/2019 | De Gaillard | F01D 11/008 |
| 2020/0123921 | A1 | 4/2020 | Kray et al. | |
| 2020/0355082 | A1* | 11/2020 | Theertham | F01D 11/008 |

* cited by examiner

FAN RETENTION MEMBER FOR SUPPORTING A BLADE PLATFORM OF A FAN ASSEMBLY

PRIORITY INFORMATION

The present application claims priority to Indian Patent Application Number 202311008703 filed on Feb. 10, 2023.

FIELD

The present disclosure relates generally to fan assemblies and more particularly to a fan retention member for supporting a blade platform in a fan assembly, such as a fan assembly of a gas turbine engine.

BACKGROUND

A gas turbine engine generally includes a fan and a core arranged in fluid communication with one another. The core of the gas turbine engine generally includes, in serial flow order, a compressor section, a combustion section, a turbine section, and an exhaust section. The fan includes a plurality of circumferentially spaced fan blades extending radially outward from a rotor disk. During operation of the gas turbine engine, ambient air is channeled between adjacent rotating fan blades and pressurized thereby, which may generate thrust for powering an aircraft in flight. Further, at least a portion of the air flowing over the fan blades may be provided to the core of the gas turbine engine.

Gas turbine engines operating at higher fan speeds generally have better efficiencies. A higher fan blade speed leads to an increase in a fan radius ratio of the fan due to the mechanical limitations at the disk. Another contributor for the fan radius ratio is the platform packaging requirement. Accordingly, the platforms need to be sized such that sufficient space is available to accommodate the ribs of the platform and to also accommodate the forward support needed at the aft spacer ring.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DEFINITIONS

Figure 1:
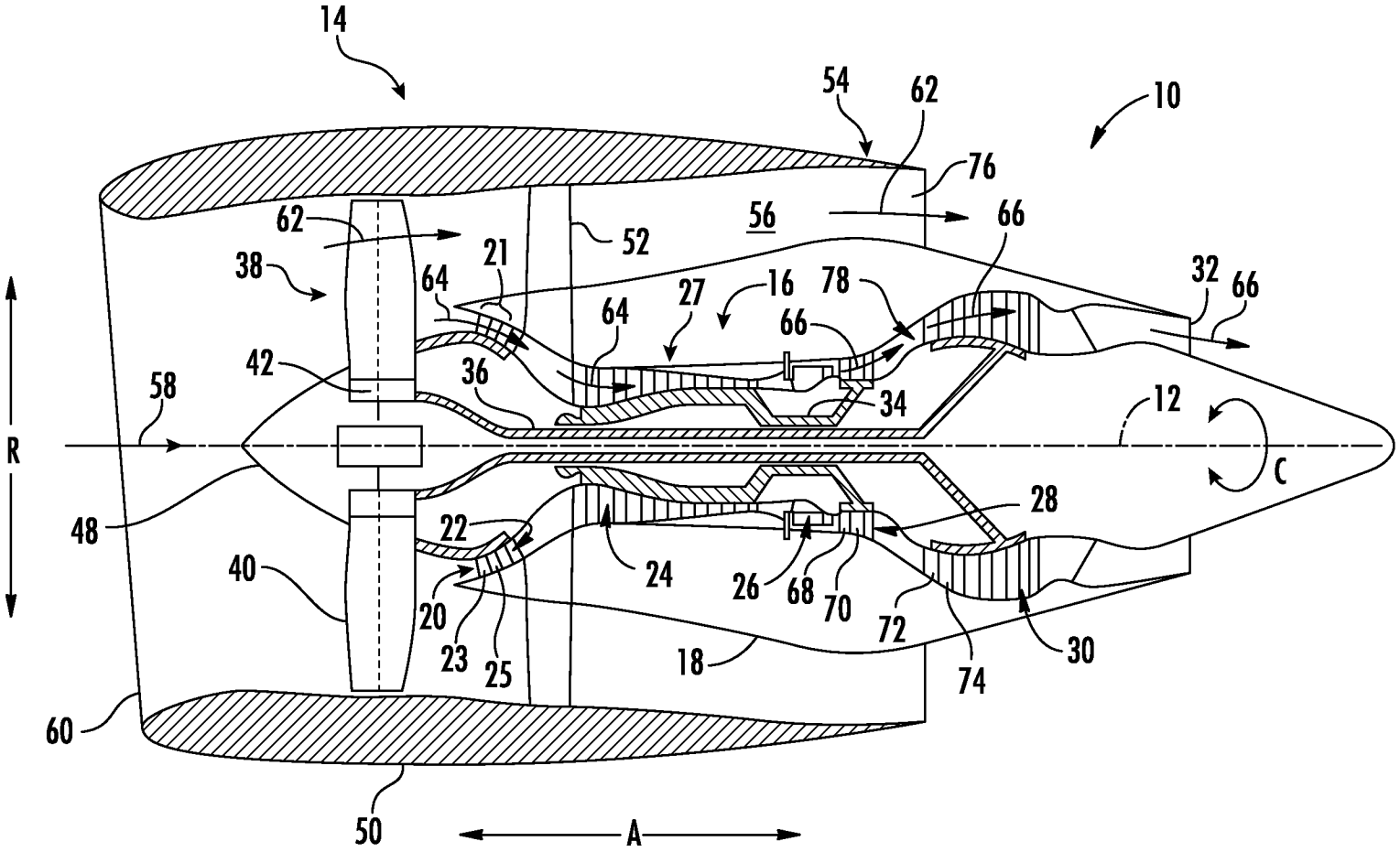
FIG. 1 is a schematic cross-sectional view of a gas turbine engine in accordance with an exemplary aspect of the present disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The singular forms "a," "an," and "the" include plural references unless the context clearly dictates otherwise.

The term "at least one of" in the context of, e.g., "at least one of A, B, and C" refers to only A, only B, only C, or any combination of A, B, and C.

The term "turbomachine" or "turbomachinery" refers to a machine including one or more compressors, a heat generating section (e.g., a combustion section), and one or more turbines that together generate a torque output.

The term "gas turbine engine" refers to an engine having a turbomachine as all or a portion of its power source. Example gas turbine engines include turbofan engines, turboprop engines, turbojet engines, turboshaft engines, etc., as well as hybrid-electric versions of one or more of these engines.

The terms "upstream" and "downstream" refer to the relative direction with respect to fluid flow in a fluid pathway. For example, "upstream" refers to the direction from which the fluid flows, and "downstream" refers to the direction to which the fluid flows.

As used herein, the terms "axial" and "axially" refer to directions and orientations that extend substantially parallel to a centerline of the gas turbine engine. Moreover, the terms "radial" and "radially" refer to directions and orientations that extend substantially perpendicular to the centerline of the gas turbine engine. In addition, as used herein, the terms "circumferential" and "circumferentially" refer to directions and orientations that extend arcuately about the centerline of the gas turbine engine.

The terms "coupled," "fixed," "attached to," and the like refer to both direct coupling, fixing, or attaching, as well as indirect coupling, fixing, or attaching through one or more intermediate components or features, unless otherwise specified herein.

As used herein, the terms "first" and "second" may be used interchangeably to distinguish one component from another and are not intended to signify location or importance of the individual components.

For purposes of the description hereinafter, the terms "upper," "lower," "right," "left," "vertical," "horizontal," "top," "bottom," "lateral," "longitudinal," and derivatives thereof shall relate to the embodiments as they are oriented in the drawing figures. However, it is to be understood that the embodiments may assume various alternative variations, except where expressly specified to the contrary. It is also to be understood that the specific devices illustrated in the attached drawings, and described in the following specification, are simply exemplary embodiments of the disclosure. Hence, specific dimensions and other physical characteristics related to the embodiments disclosed herein are not to be considered as limiting.

The term "adjacent" as used herein with reference to two walls and/or surfaces refers to the two walls and/or surfaces contacting one another, or the two walls and/or surfaces being separated only by one or more nonstructural layers and the two walls and/or surfaces and the one or more nonstructural layers being in a serial contact relationship (i.e., a first wall/surface contacting the one or more nonstructural layers, and the one or more nonstructural layers contacting the a second wall/surface).

As used herein, the terms "integral," "unitary," or "monolithic" as used to describe a structure refers to the structure being formed integrally of a continuous material or group of materials with no seams, connections joints, or the like. The integral, unitary structures described herein may be formed through additive manufacturing to have the described structure, or alternatively through a ply layup process, a casting process, etc.

The term "unitary" as used herein denotes that the final component has a construction in which the integrated portions are inseparable and is different from a component comprising a plurality of separate component pieces that have been joined together but remain distinct and the single component is not inseparable (i.e., the pieces may be reseparated). Thus, unitary components may comprise generally substantially continuous pieces of material or may comprise a plurality of portions that are permanently bonded to one another. In any event, the various portions forming a unitary component are integrated with one another such that the unitary component is a single piece with inseparable portions.

As used herein, the term "composite material" refers to a material produced from two or more constituent materials, wherein at least one of the constituent materials is a nonmetallic material. Example composite materials include polymer matrix composites (PMC), ceramic matrix composites (CMC), chopped fiber composite materials, etc.

As used herein, polymer-matrix-composite or "PMC" refers to a class of materials that include a reinforcing material (e.g., reinforcing fibers) surrounded by a polymer matrix phase. PMCs are typically fabricated by impregnating a fabric or unidirectional tape with a resin (prepreg), followed by curing. Prior to impregnation, the fabric may be referred to as a "dry" fabric and typically comprises a stack of two or more fiber layers (plies). The fiber layers may be formed of a variety of materials, nonlimiting examples of which include carbon (e.g., graphite), glass (e.g., fiberglass), polymer (e.g., aromatic polyamide or Kevlar®) fibers, and metal fibers. Fibrous reinforcement materials can be used in the form of relatively short chopped fibers, generally less than two inches in length, and more preferably less than one inch, or long continuous fibers, the latter of which are often used to produce a woven fabric or unidirectional tape. PMC materials can be produced by dispersing dry fibers into a mold, and then flowing matrix material around the reinforcement fibers, or by using prepreg. For example, multiple layers of prepreg may be stacked to the proper thickness and orientation for the part, and then the resin may be cured and solidified to render a fiber reinforced composite part. Resins for PMC matrix materials can be generally classified as thermosets or thermoplastics. Thermoplastic resins are generally categorized as polymers that can be repeatedly softened and flowed when heated and hardened when sufficiently cooled due to physical rather than chemical changes. Notable example classes of thermoplastic resins include nylons, thermoplastic polyesters, polyaryletherketones, and polycarbonate resins. Specific examples of high performance thermoplastic resins that have been contemplated for use in aerospace applications include polyetheretherketone (PEEK), polyetherketoneketone (PEKK), polyetherimide (PEI), and polyphenylene sulfide (PPS). In contrast, once fully cured into a hard rigid solid, thermoset resins do not undergo significant softening when heated but, instead, thermally decompose when sufficiently heated. Notable examples of thermoset resins include epoxy, bismaleimide (BMI), and polyimide resins.

As used herein, ceramic-matrix-composite or "CMC" refers to a class of materials that include a reinforcing material (e.g., reinforcing fibers) surrounded by a ceramic matrix phase. Generally, the reinforcing fibers provide structural integrity to the ceramic matrix. Some examples of matrix materials of CMCs can include, but are not limited to, non-oxide silicon-based materials (e.g., silicon carbide, silicon nitride, or mixtures thereof), oxide ceramics (e.g., silicon oxycarbides, silicon oxynitrides, aluminum oxide ($Al_2O_3$), silicon dioxide ($SiO_2$), aluminosilicates, or mixtures thereof), or mixtures thereof. Optionally, ceramic particles (e.g., oxides of Si, Al, Zr, Y, and combinations thereof) and inorganic fillers (e.g., pyrophyllite, wollastonite, mica, talc, kyanite, and montmorillonite) may also be included within the CMC matrix.

Some examples of reinforcing fibers of CMCs can include, but are not limited to, non-oxide silicon-based materials (e.g., silicon carbide, silicon nitride, or mixtures thereof), non-oxide carbon-based materials (e.g., carbon), oxide ceramics (e.g., silicon oxycarbides, silicon oxynitrides, aluminum oxide ($Al_2O_3$), silicon dioxide ($SiO_2$), aluminosilicates such as mullite, or mixtures thereof), or mixtures thereof.

Generally, particular CMCs may be referred to as their combination of type of fiber/type of matrix. For example, C/SiC for carbon-fiber-reinforced silicon carbide; SiC/SiC for silicon carbide-fiber-reinforced silicon carbide, SiC/SiN for silicon carbide fiber-reinforced silicon nitride; SiC/SiC—SiN for silicon carbide fiber-reinforced silicon carbide/silicon nitride matrix mixture, etc. In other examples, the CMCs may include a matrix and reinforcing fibers comprising oxide-based materials such as aluminum oxide ($Al_2O_3$), silicon dioxide ($SiO_2$), aluminosilicates, and mixtures thereof. Aluminosilicates can include crystalline materials such as mullite ($3Al_2O_3 \cdot 2SiO_2$), as well as glassy aluminosilicates.

In certain embodiments, the reinforcing fibers may be bundled and/or coated prior to inclusion within the matrix. For example, bundles of the fibers may be formed as a reinforced tape, such as a unidirectional reinforced tape. A plurality of the tapes may be laid up together to form a preform component. The bundles of fibers may be impregnated with a slurry composition prior to forming the preform or after formation of the preform. The preform may then undergo thermal processing and subsequent chemical processing to arrive at a component formed of a CMC material having a desired chemical composition. For example, the preform may undergo a cure or burn-out to yield a high char residue in the preform, and subsequent melt-infiltration with silicon, or a cure or pyrolysis to yield a silicon carbide matrix in the preform, and subsequent chemical vapor infiltration with silicon carbide. Additional steps may be taken to improve densification of the preform, either before or after chemical vapor infiltration, by injecting it with a liquid resin or polymer followed by a thermal processing step to fill the voids with silicon carbide. CMC material as used herein may be formed using any known or hereinafter developed methods including but not limited to melt infiltration, chemical vapor infiltration, polymer impregnation pyrolysis (PIP), or any combination thereof.

Such materials, along with certain monolithic ceramics (i.e., ceramic materials without a reinforcing material), are particularly suitable for higher temperature applications. Additionally, these ceramic materials are lightweight compared to superalloys, yet can still provide strength and durability to the component made therefrom. Therefore, such materials are currently being considered for many gas turbine components used in higher temperature sections of gas turbine engines, such as airfoils (e.g., turbines, and vanes), combustors, shrouds and other like components, that would benefit from the lighter-weight and higher temperature capability these materials can offer.

DETAILED DESCRIPTION

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

Fan platforms located between adjacent fan blades, near the rotor disk, provide a radially inner flowpath boundary for the airflow directed between the plurality of fan blades. The fan platforms can experience significant forces or stresses during operation of the fan, and one or more components may be provided to support the fan platforms and mitigate negative impacts of force or stress on the fan platforms. However, such support components often occupy space in the region of the fan that can increase fan platform packaging requirements, thereby increasing a fan radius ratio. Moreover, fans of gas turbine engines are more commonly being operated at higher fan speeds to increase efficiency, but higher fan speeds usually require an increased fan radius ratio due to mechanical limitations at the connection between the fan blades and the rotor disk. Accordingly, improved components addressing one or more of these challenges would be desirable.

Generally, the present disclosure is related to fan retention members for supporting blade platforms relative to, e.g., a disk to which the fan blades are attached. Notably, the fan retention members are configured to reduce the platform packaging arrangement, providing a more compact blade and disk assembly. For example, the blade platforms can be platforms of fan blades of a gas turbine engine fan, and the fan retention members can support the blade platforms relative to the disk while lowering a radius ratio of the fan. Moreover, the fan retention members are configured to reduce stress on the blade platforms. Further, the fan retention members can support the blade platforms adjacent a forward end of the blade platforms and eliminate the need for support of the blade platforms at or near an aft end of the blade platforms. Advantageously, a lower fan radius ratio can increase fan bypass and increase fuel efficiency of the engine, reduce stress and improve part life, and eliminate the need for aft support. Eliminating the need for the aft support can reduce complexity and weight, which may improve manufacturing time and manufacturing accuracy and increase fuel efficiency.

Referring now to the drawings, wherein identical numerals indicate the same elements throughout the figures, FIG. 1 is a schematic cross-sectional view of a gas turbine engine 10 in accordance with an exemplary aspect of the present disclosure. More particularly, for the embodiment of FIG. 1, the gas turbine engine 10 is a high-bypass turbofan jet engine, referred to herein as "turbofan engine 10." As shown in FIG. 1, the turbofan engine 10 defines an axial direction A (extending parallel to a longitudinal centerline 12 provided for reference), a circumferential direction C (extending about the longitudinal centerline 12 and the axial direction A), and a radial direction R. In general, the turbofan engine 10 includes a fan section 14 and a core turbine engine 16 disposed downstream from the fan section 14.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22.

Figure 2:
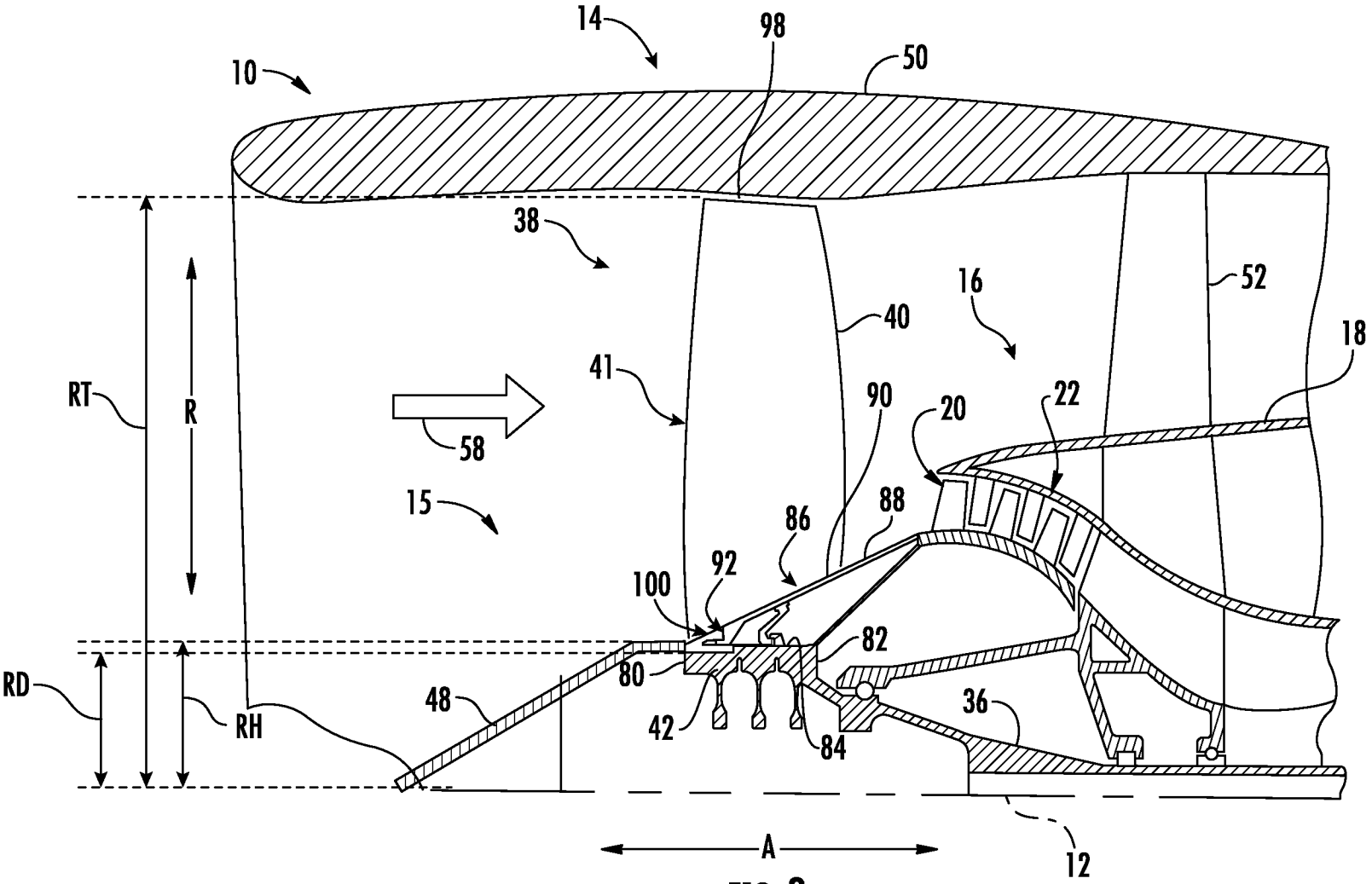
FIG. 2 is a schematic, cross-sectional view of a forward end of the gas turbine engine of FIG. 1 in accordance with an exemplary aspect of the present disclosure.

For the depicted embodiment, as shown particularly in FIG. 2, fan section 14 includes a fan assembly 15 having a fan 38 with a plurality of fan blades 40 coupled to a disk 42 or hub in a spaced apart manner. As depicted, fan blades 40 extend outward from disk 42 generally along the radial direction R. The fan blades 40 and disk 42 are together rotatable about the longitudinal centerline 12 by LP shaft 36. As such, the disk 42 may also be referred to as a rotor disk. In some embodiments, a power gearbox having a plurality of gears may be included for stepping down the rotational speed of the LP shaft 36 to a more efficient rotational fan speed.

Referring still to the exemplary embodiment of FIG. 1, the disk 42 is covered by a rotatable front hub 48 or nacelle aerodynamically contoured to promote an airflow through the plurality of fan blades 40. Additionally, the exemplary fan section 14 includes an annular fan casing 50 or outer nacelle that circumferentially surrounds the fan assembly 15 and/or at least a portion of the core turbine engine 16. It should be appreciated that fan casing 50 (nacelle) may be configured to be supported relative to the core turbine engine 16 by a plurality of circumferentially spaced outlet guide vanes 52. Moreover, a downstream section 54 of the fan casing 50 may extend over an outer portion of the core turbine engine 16 to define a bypass airflow passage 56 therebetween.

During operation of the turbofan engine 10, a volume of air 58 enters turbofan engine 10 through an associated inlet 60 of the fan casing 50 and/or fan section 14. As the volume of air 58 passes across fan blades 40, a first portion of the air 58 as indicated by arrows 62 is directed or routed into the bypass airflow passage 56 and a second portion of the air 58 as indicated by arrows 64 is directed or routed into the LP compressor 22. The ratio between the first portion of air 62 and the second portion of air 64 is commonly known as a bypass ratio.

The pressure of the second portion of air 64 is then increased as it is routed through the compressor section and into the combustion section 26, where it is mixed with fuel and burned to provide combustion gases 66. More particularly, the compressor section includes the LP compressor 22 and the HP compressor 24 that each may comprise a plurality of compressor stages 21, with each stage 21 including both an annular array or circumferential row of stationary compressor vanes 23 (also referred to as compressor stator vanes 23) and an annular array or circumferential row of rotating compressor blades 25 (also referred to as compressor rotor blades 25) positioned immediately downstream of the compressor vanes 23.

The plurality of compressor blades 25 in the LP compressor 22 are coupled to the LP shaft or spool 36, and the plurality of compressor blades 25 in the HP compressor 24 are coupled to the HP shaft or spool 34. The plurality of compressor vanes 23 in the LP compressor 22 are coupled to a compressor casing, and the plurality of compressor vanes 23 in the HP compressor 24 are coupled to a compressor casing; at least a portion of the HP compressor vanes 23 are coupled to a compressor casing 27. In some embodiments, the compressor casing 27 may extend through both the LP compressor 22 and the HP compressor 24 and support all of the compressor vanes 23. In other embodiments, the compressor casing 27 supports only a portion of the compressor vanes 23 and may support only a portion of the compressor vanes 23 in the HP compressor 24. As previously described, as the second portion of air 64 passes through the sequential stages of compressor vanes 23 and blades 25, the volume of air 64 is pressurized, i.e., the pressure of the air 64 is increased prior to combustion with fuel in the combustion section 26 to form the combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core turbine engine 16.

Although the gas turbine engine of FIG. 1 is depicted in a turboshaft configuration, it will be appreciated that the teachings of the present disclosure can apply to other types of turbine engines, turbomachines more generally, and other shaft systems. For example, the turbine engine may be another suitable type of gas turbine engine, such as e.g., a turboprop, turbojet, turbofan, aeroderivative, etc.

Referring now to FIG. 2, a partial, close-up view of the turbofan engine 10 of FIG. 1 is provided. As shown, the fan assembly 15 includes the disk 42 and the fan 38 having the plurality of circumferentially spaced fan blades 40 (only one of which is shown in FIG. 2) extending radially outward from the disk 42. The fan assembly 15 is circumferentially arranged about the longitudinal centerline 12 that extends along the axial direction A. The disk 42 includes a disk forward surface 80 and a disk aft surface 82 that are spaced apart along the axial direction A and a radially outer surface 84 extending between the disk forward surface 80 and the disk aft surface 82. At least at the radially outer portion of the disk 42, the disk forward surface 80 may be the forwardmost surface of the disk 42 and the disk aft surface 82 may be the aftmost surface of the disk 42.

For the embodiment depicted, the LP shaft 36 is suitably fixedly joined directly to the disk 42, e.g., by a plurality of bolts or the like. However, in other embodiments, the turbofan engine 10 may include a geared fan configuration, such that a gearbox is disposed between the LP shaft 36 and the fan assembly 15. For example, in such a geared fan configuration, the LP shaft 36 may be fixedly joined to an input shaft, the input shaft coupled to the gearbox, and the gearbox also mechanically coupled to a fan shaft for driving the fan assembly 15.

Referring still to FIG. 2, the fan assembly 15 additionally includes a plurality of platforms 86 (only one of which is shown in FIG. 2) that are provided between each pair of adjacent fan blades 40 of the plurality of fan blades 40. Specifically, each platform 86 is disposed between a respective pair of adjacent fan blades 40 and radially outward from the disk 42. Each of the platforms 86 has a radially outer surface 88 extending between the respective adjacent fan blades 40 to collectively define an inner flowpath boundary for channeling air 58 between the fan blades 40. Thus, the platforms 86 help maintain the engine flowpath definition between the rotatable front hub 48 and the LP compressor 22.

In some embodiments, the platforms 86 may be attached to or integrally formed with the fan blades 40. For example, in an embodiment, a respective fan blade 40 of the plurality of fan blades 40 of the fan 38 may include all of or at least a portion of a platform 86. The platform 86 (whether the entire platform 86 or a portion of the platform 86) may be formed as a separate component and attached to the fan blade 40, or in other embodiments, the fan blade 40 and the platform 86 (whether the entire platform 86 or a portion of the platform 86) may be integrally formed as a single, unitary component, such as through a composite layup or molding process, a casting process, a machining process, an additive manufacturing process, or other suitable process. In other embodiments, the platforms 86 may be discrete components of the fan assembly 15 that are separate from the fan blades 40.

Figure 3:
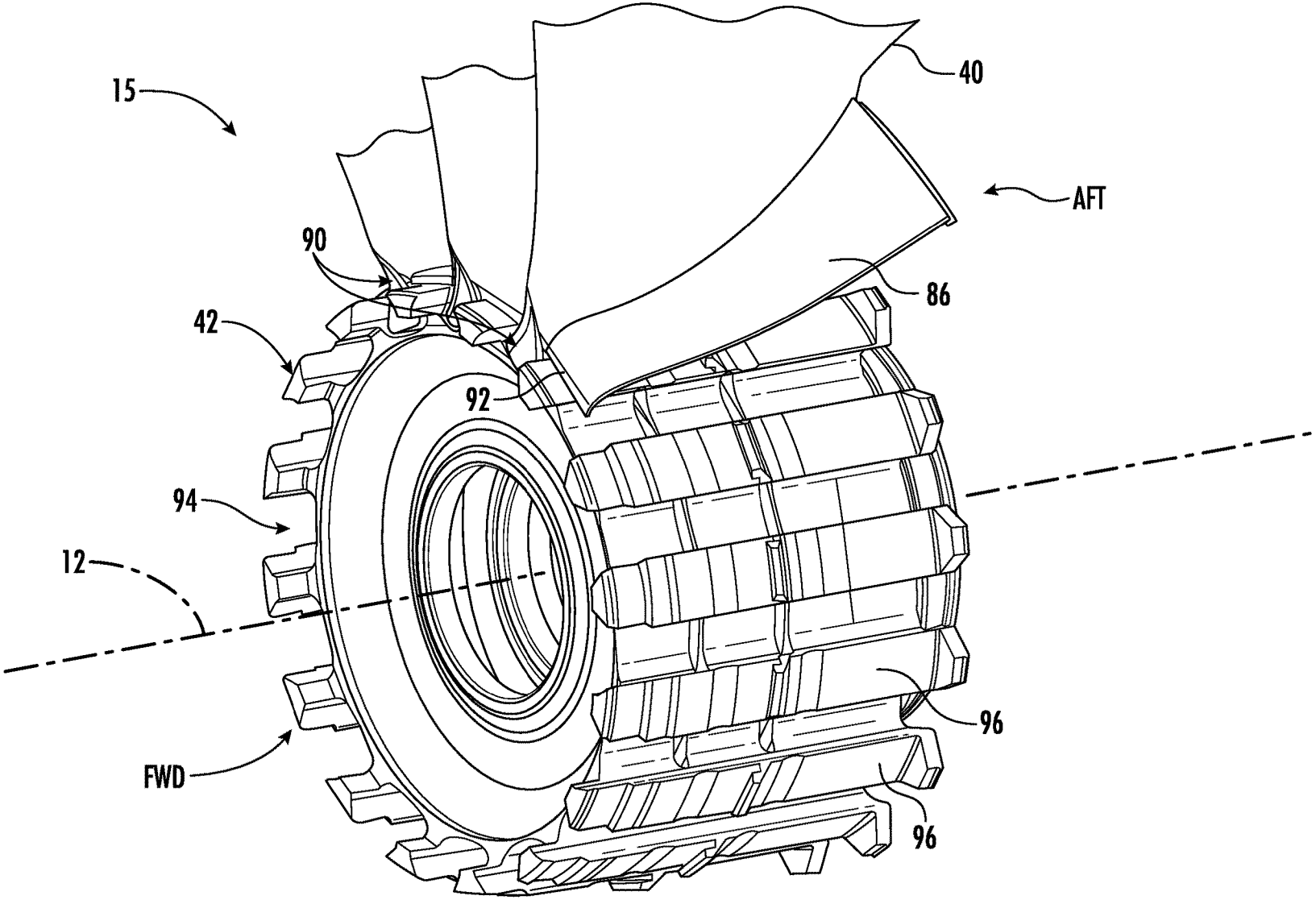
FIG. 3 is a side, perspective view of a portion of a fan assembly, including a disk and a portion of a plurality of fan blades and a portion of a plurality of platforms of the fan assembly, in accordance with an exemplary aspect of the present disclosure.

Each fan blade 40 includes a blade root 90 (FIG. 3). Thus, as shown, the blade root 90 of a respective fan blade 40 defines the radially innermost portion of the fan blade 40. Furthermore, as shown, the blade root 90 of each fan blade 40 interfaces with the disk 42 to attach the fan blades 40 to the disk 42. Moreover, as shown, the platforms 86 are disposed adjacent the blade roots 90. As shown in FIG. 2 and described in greater detail with respect to FIG. 4, each platform 86 has a platform forward surface 92 that is offset from the disk forward surface 80 along the axial direction A. In the depicted embodiments, the platform forward surface 92 is disposed axially aft of the disk forward surface 80 such that the fan blades 40 are positioned directly outward along the radial direction R from the platform forward surface 92 of each platform 86.

Referring particularly to FIG. 3, the disk 42 defines a plurality of disk slots 94 in the radially outer surface 84 of the disk 42. The plurality of disk slots 94 are spaced apart from one another along the circumferential direction C. Accordingly, as shown, the blade root 90 of each fan blade 40 of the plurality of fan blades 40 is received in a disk slot 94 of the plurality of disk slots 94 such that a respective blade root 90 is disposed in a respective disk slot 94. Further, the disk 42 includes a plurality of disk posts 96. As shown in FIG. 3, each disk post 96 of the plurality of disk posts 96 extends along the radial direction R between two adjacent disk slots 94 such that each disk post 96 of the plurality of disk posts 96 defines a portion of a respective disk slot 94 of the plurality of disk slots 94.

Figure 4:
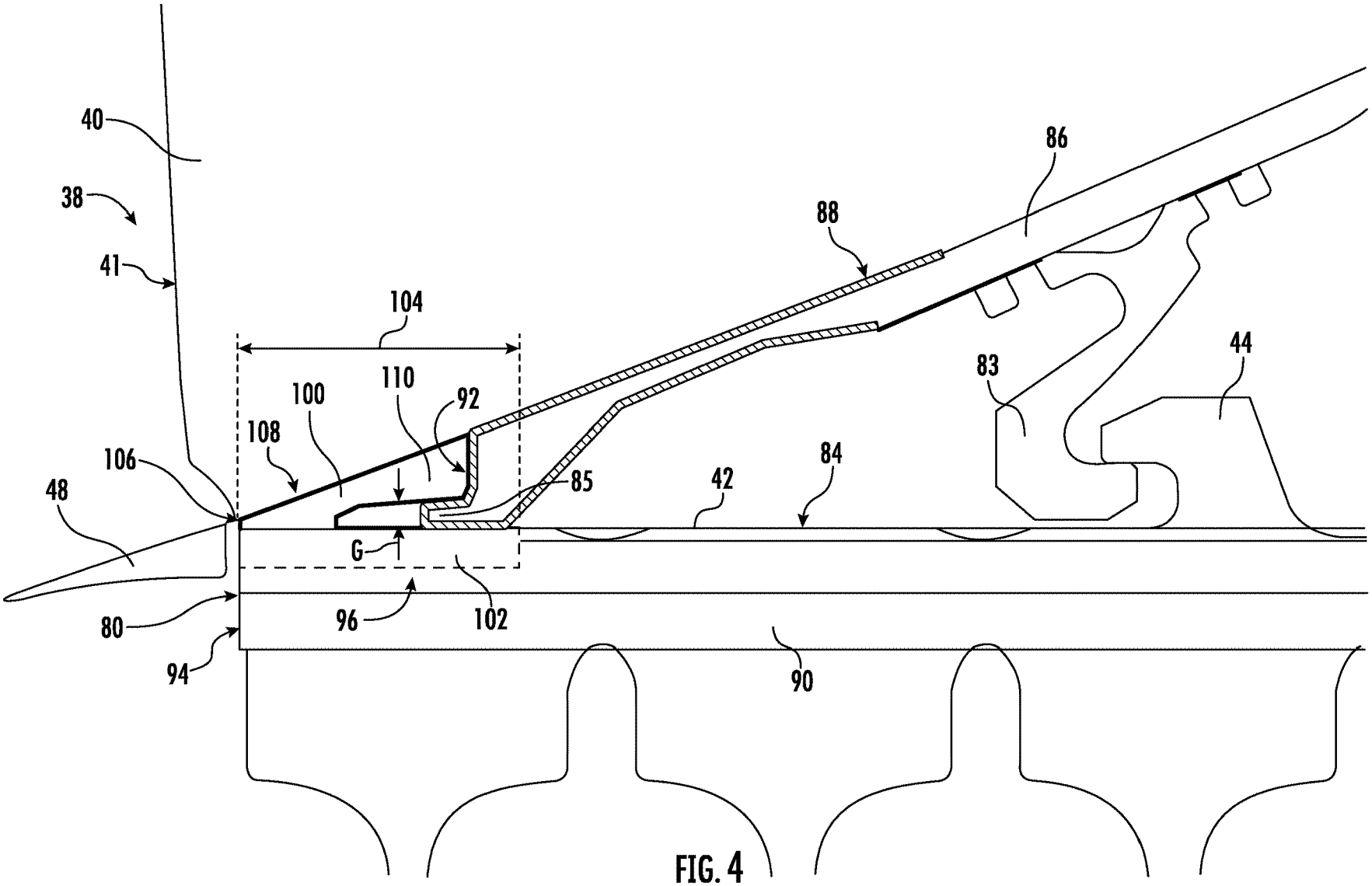
FIG. 4 is a schematic close-up view of a portion of a fan assembly including a fan retention member positioned at a forward end of a disk in accordance with an exemplary aspect of the present disclosure.
Figure 5:
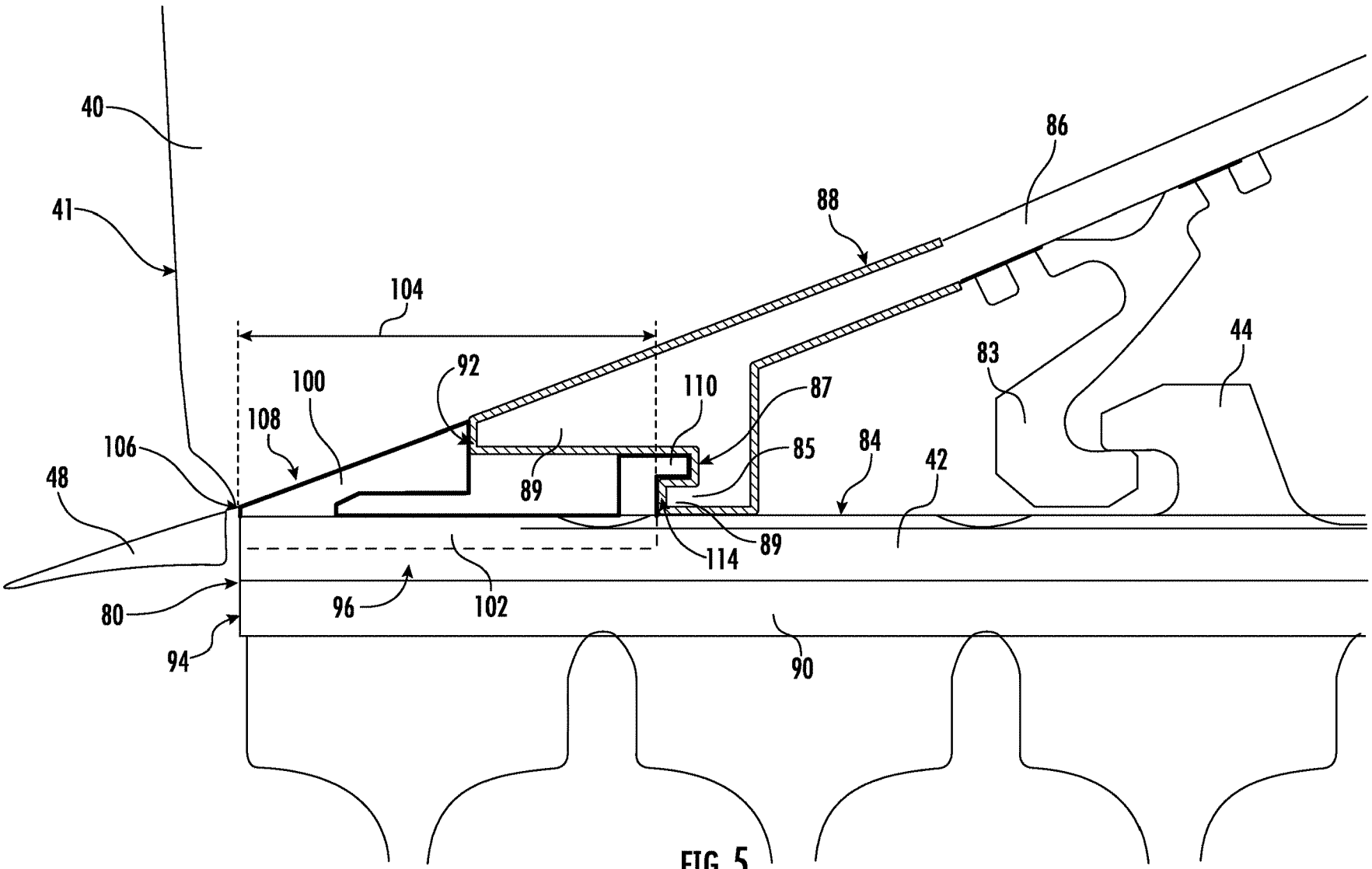
FIG. 5 is a schematic close-up view of a portion of a fan assembly including a fan retention member positioned at a forward end of a disk in accordance with an exemplary aspect of the present disclosure.

Referring particularly to FIGS. 4 and 5, the disk 42 may further define a plurality of disk hooks 44 and each platform 86 may define a platform hook 83 that interfaces with or attaches to a respective disk hook 44 of the plurality of disk hooks 44 to help secure the platforms 86 with respect to the disk 42. The disk hooks 44 may be attached to, fixed to, joined to, or integral with the disk posts 96. Similarly, the platform hooks 83 may be attached to, fixed to, joined to, or integral with the platforms 86. The disk hooks 44 and the platform hooks 83 hook and interface together to secure the platforms 86 to the disk 42.

Referring particularly to FIGS. 4-7B, the fan assembly 15 further includes at least one fan retention member 100 (not shown in FIG. 6A) for supporting the platforms 86 extending between the fan blades 40. In particular, as shown, the fan retention member(s) 100 may be attached to the disk 42. In certain embodiments, for example, one or more of the disk posts 96 of the disk 42 may include a post slot 95 (FIGS. 6A and 6B) for receiving at least a portion of one of the fan retention members 100. Accordingly, as shown, the fan retention member(s) 100 are sized to be received within the post slots 95 in the disk posts 96 of the disk 42.

As particularly shown in FIGS. 4, 5, and 6A-7B, the fan retention member(s) 100 described herein may further include a protrusion 102 having a length 104 (FIGS. 4 and 5) extending along the axial direction A. Further, as shown in FIGS. 4 and 5, the fan retention member 100 defines a forward edge 106, with the protrusion 102 extending aft from the forward edge 106. In the embodiment depicted in FIG. 4, the fan retention member 100 is received in the disk 42 such that the forward edge 106 of the fan retention member 100 is positioned at the disk forward surface 80, and the protrusion 102 extends from the disk forward surface 80 of the disk 42 toward the disk aft surface 82. Thus, as shown, the fan retention member 100 extends from the disk forward surface 80 of the disk 42 and ends before the disk aft surface 82 (FIG. 2) (i.e., less than a maximum length 104 of the protrusion 102 may be substantially equal to the axial width of the disk 42 from the disk forward surface 80 to the disk aft surface 82). In some embodiments, the protrusion 102 can extend from the disk forward surface 80 to the disk aft surface 82, i.e., the maximum length 104 of the protrusion 102 may be substantially equal to the axial width of the disk 42 from the disk forward surface 80 to the disk aft surface 82. Moreover, in the illustrated embodiment, the forward edge 106 is disposed adjacent a leading edge 41 of each of the fan blades 40 extending radially outward from the platforms 86.

Referring particularly to FIG. 2, each fan blade 40 of the plurality of fan blades 40 defines a blade tip 98 radially opposite the blade root 90. A hub radius RH is defined or measured along the radial direction R from the longitudinal centerline 12 to an interface of a leading edge 41 of the fan blade 40 with an aerodynamic flow path, as shown. A tip radius RT is defined or measured along the radial direction R from the longitudinal centerline 12 to the blade tip 98 of a respective fan blade 40 of the plurality of fan blades 40. A fan radius ratio is defined as a ratio of the hub radius RH to the tip radius RT, i.e., the fan radius ratio equals RH/RT. The fan assembly 15 of the present disclosure may be designed with a relatively small fan radius ratio, or a lower fan radius ratio than other, known designs. For instance, in some embodiments, the fan radius ratio may be minimized, e.g., within a range of about 0.20 to about 0.35.

Accordingly, in an embodiment, the fan retention member 100 assists in lowering the fan radius ratio. For example, when the fan retention member 100 is inserted into the disk 42, the forward edge 106 is disposed at the disk forward surface 80, at a radial location that is no farther from the longitudinal centerline 12 (FIG. 3) along the radial direction R than the radially outer surface 84 of the disk 42. That is, as shown in FIG. 4, the forward edge 106 of the fan retention member 100 is positioned at the radially outer surface 84 of the disk 42 such that the hub radius RH is substantially equal to a disk radius RD (FIG. 2) defined along the radial direction R from the longitudinal centerline 12 to the radially outer surface 84 of the disk 42. For example, in an embodiment, the forward edge 106 of the fan retention member 100 may be positioned at the radially outer surface 84 of the disk 42 such that the hub radius is within 10% plus or minus of a disk radius RD (FIG. 2) defined along the radial direction from the longitudinal centerline to the radially outer surface 84 of the disk 42.

As such, the fan retention member 100 defines the hub radius RH of the fan 38, with a maximum value of the hub radius RH being substantially equal to a radius of the disk 42 measured from the longitudinal centerline 12 to the radially outer surface 84 of the disk 42. That is, the fan retention member 100 does not contribute to the hub radius RH, unlike known fan designs, where the hub radius is measured from the longitudinal centerline 12 to a radial location outward of the radially outer surface 84 of the disk 42, as defined by a feature defining the inner flowpath boundary through the fan section 14. Accordingly, for a fan assembly 15 utilizing the fan retention member 100, an annular area for the air 58 to flow through the fan section 14 can be measured at the disk forward surface 80 between the radially outer surface 84 of the disk 42 and an inner surface of the fan casing 50 (nacelle).

Stated differently, as described with respect to the platforms 86, the fan retention member(s) 100 defines an inner flowpath boundary at a forward end of the fan assembly 15 for channeling air 58 between the fan blades 40. Thus, the fan retention member 100 maintains the engine flowpath definition between the rotatable front hub 48 and the platforms 86, and the platforms 86 maintain the engine flowpath definition between the fan retention member 100 and the LP compressor 22. With the forward edge 106 essentially at the radially outer surface 84 of the disk 42, the air 58 has a larger annular area to enter the fan section 14, which can increase the bypass of the turbofan engine 10 and increase fuel efficiency of the turbofan engine 10.

As shown in FIGS. 4 and 5, the fan retention member 100 includes a flowpath surface 108 extending from the forward edge 106, which is positioned at the disk forward surface 80, to the platform forward surface 92. Thus, as shown, the flowpath surface 108 has a shape and/or is contoured to guide the air 58 over the fan retention member 100 to the platforms 86. In certain embodiments, as shown in FIGS. 4 and 5, the flowpath surface 108 may be slanted or angled at the same angle as the radially outer surface 88 of the platforms 86 to provide a continuous surface for guiding the air 58. In some embodiments, as shown in FIG. 7C, the flowpath surface 108 may have a shape or contour that includes "scooping," where the flowpath surface 108 dips radially inward toward the longitudinal centerline 12. In such embodiments, the flowpath scooping can provide an additional reduction in the fan radius ratio by reducing the hub radius.

Referring still to FIG. 4, the fan retention member(s) 100 includes a flange 110 extending along the axial direction A aft of the forward edge 106. In certain embodiments, as shown, the flange 110 may be spaced apart from the protrusion 102 along the radial direction R such that a gap G is defined between the flange 110 and the protrusion 102. Accordingly, in certain embodiments, the protrusion 102 and the flange 110 with the gap G formed therebetween may form a hook shape, such that together, the protrusion 102, the flange 110, and the gap G may be referred to as a fan retention hook.

Furthermore, as shown in the embodiment of FIG. 4, each platform 86 of the fan 38 includes a platform flange 85 that is received in the gap G. Thus, as shown in FIG. 4, the platform flange 85 can interface with the fan retention member 100, and the fan retention member 100 can support the platforms 86 through the interface between the platform flange 85 of each platform 86 and the fan retention member 100. For example, stresses on the fan blades 40 and/or platforms 86 can be transferred to the fan retention member (s) 100 through the interface between the fan retention member(s) 100 and the platforms 86 at the flange 110 and the platform flange 85. More generally, the fan retention hook (formed by the protrusion 102, flange 110, and gap G) supports at least a respective platform 86 of the plurality of platforms 86 of the fan 38.

As further illustrated in FIG. 4, the interface between the platforms 86 and the fan retention member(s) 100 is axially aft of the disk forward surface 80, e.g., radially inward of the fan blades 40 extending radially from the platforms 86. For instance, the platform flange 85 of each platform 86 and the flange 110 are disposed at an axial location that is aft of the disk forward surface 80 such that the interface between the platforms 86 and the fan retention member 100 is under the fan blades 40. Locating the interface between the fan retention member 100 and platforms 86 axially aft of the disk forward surface 80 can help ensure the fan retention member 100 provides adequate support to the platforms 86 while also allowing a relatively low hub radius RH. For example, providing the interface between the fan retention member 100 and the platforms 86 under the fan blades 40 eliminates any contribution to the hub radius RH from the interface between the fan retention member 100 and platforms 86.

Referring particularly to FIG. 5, in some embodiments, the interface between the fan retention member 100 and the platforms 86 may be even further aft than shown in FIG. 4. For instance, the flange 110 and the platform flange 85 may each be positioned at an axial location that is farther from the disk forward surface 80 than the axial location at which the flange 110 and the platform flange 85 are disposed in the embodiment of FIG. 4. Moreover, in the embodiment depicted in FIG. 5, rather than defining a gap G between the protrusion 102 and the flange 110, the fan retention member 100 may have a recess 114 defined by the protrusion 102 and the flange 110. Accordingly, in such embodiments, the platform flange 85 may be received in the recess 114 to join together the fan retention member 100 and the platform 86. Additionally, similar to the embodiment of FIG. 4, the platform 86 may define a platform hook 89 at the platform flange 85, with the flange 110 of the fan retention member 100 received in an opening 87 defined by the platform flange 85. Further, as shown, the protrusion 102 may have a longer or greater length 104 in the embodiment of FIG. 5 than in the embodiment of FIG. 4.

Figure 6A:
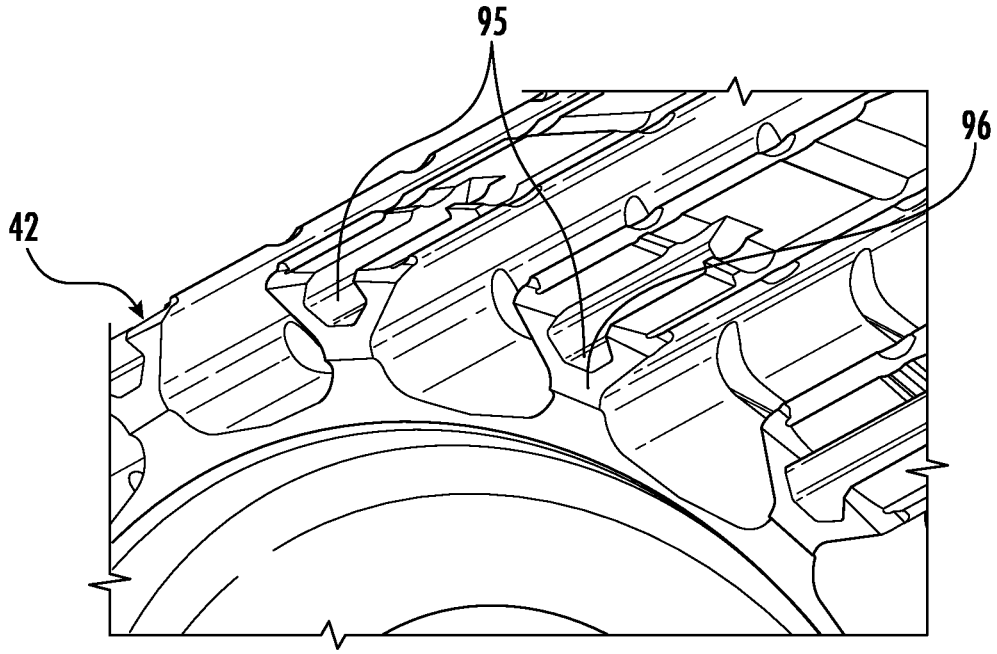
FIG. 6A is a partial perspective view of a disk of a fan assembly in accordance with an exemplary aspect of the present disclosure.
Figure 6B:
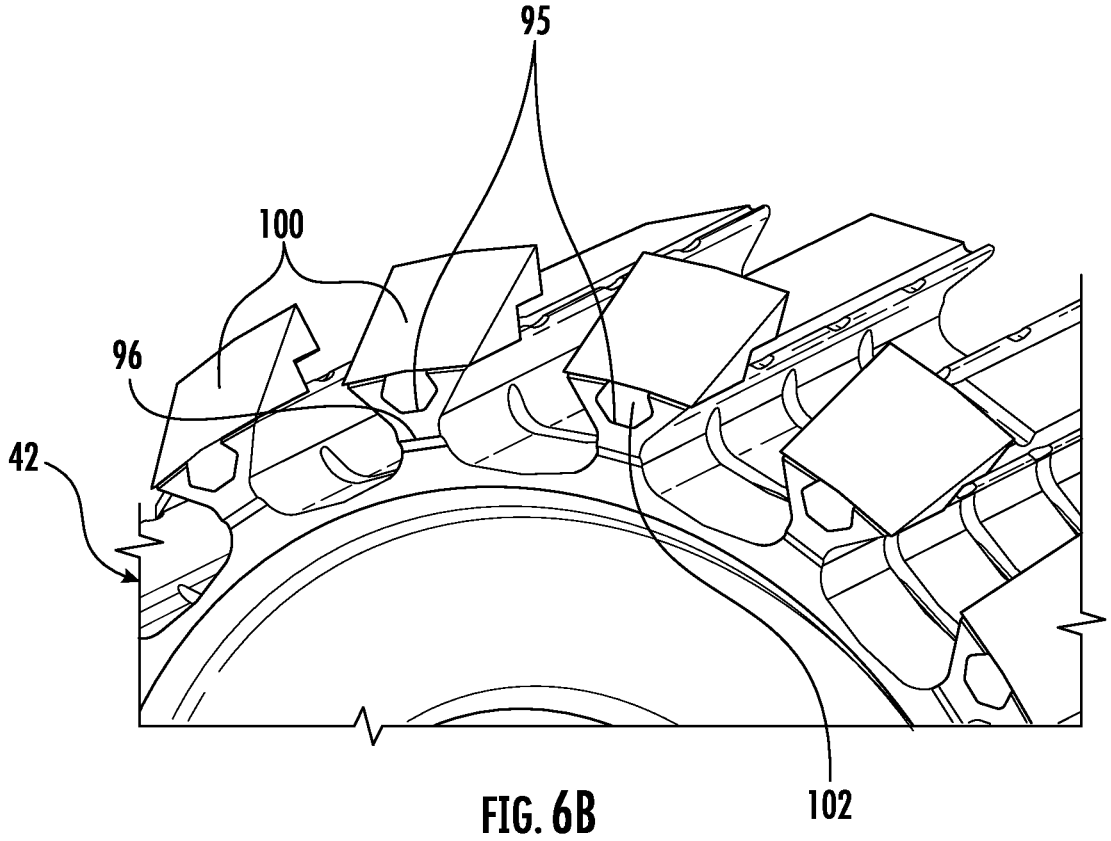
FIG. 6B is a partial perspective view of a disk of a fan assembly in accordance with an exemplary aspect of the present disclosure, particularly illustrating a plurality of fan retention members arranged within slots of the disk.
Figure 8:
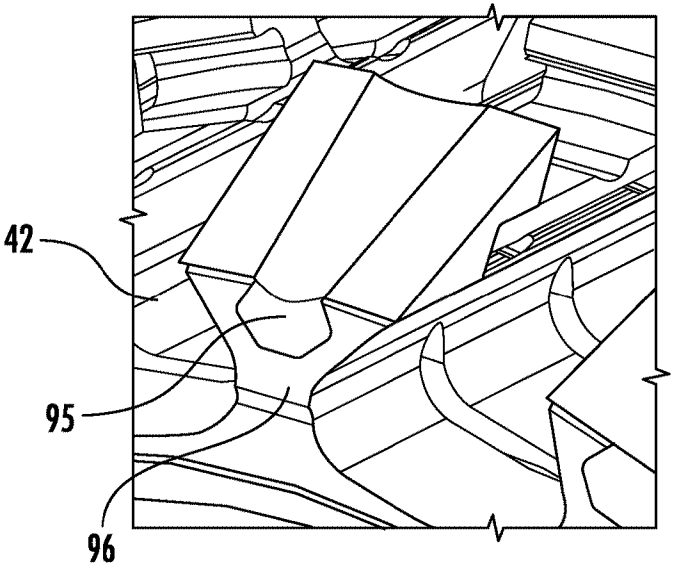
FIG. 8 is a partial perspective view of a slot of a disk of a fan assembly in accordance with an exemplary aspect of the present disclosure, particularly illustrating a scalloped shape slot formed into the disk.

Referring now to FIGS. 6A, 6B, and 8, various partial perspective views of the disk 42 and disk posts 96 of the fan assembly 15 (FIG. 2) in accordance with an exemplary aspect of the present disclosure are illustrated. In particular, FIGS. 6A and 8 illustrate partial perspective views of different embodiments of the disk 42 and corresponding disk posts 96 without the fan retention members 100 secured thereto, whereas FIG. 6B illustrates a partial perspective view of the disk 42 with the fan retention members 100 secured thereto. Thus, as shown, each of the fan retention members 100 may be secured within one of the post slots 95 of the disk posts 96 via their respective protrusions 102. Accordingly, the protrusions 102 have a root shape that is complementary to a slot shape of the post slot 95 formed into the disk posts 96. For instance, the protrusions 102 may have a dovetail shape similar to or substantially the same as a dovetail shape of the blade roots 90 (FIG. 2), which are also received in the disk slots 94.

Figure 7B:
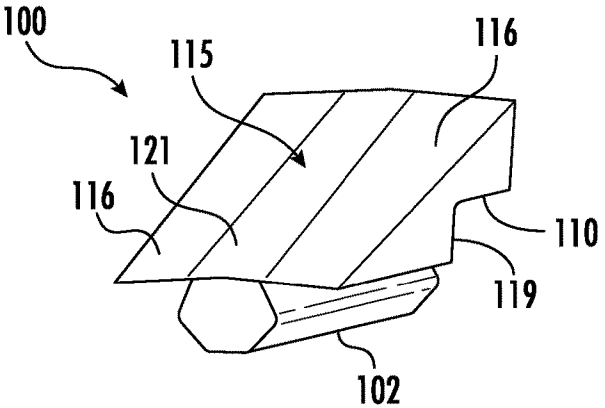
FIG. 7B is an internal, perspective view of a fan retention member for a fan assembly in accordance with an exemplary aspect of the present disclosure.
Figure 7A:
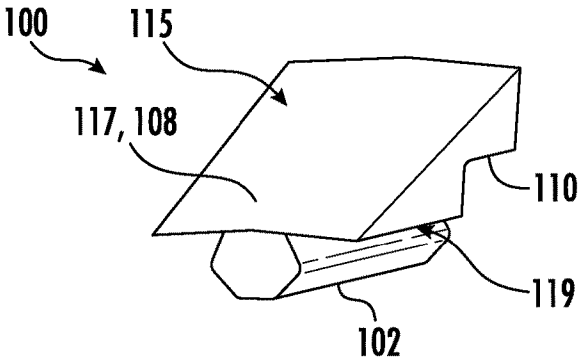
FIG. 7A is a perspective view of a fan retention member for a fan assembly in accordance with an exemplary aspect of the present disclosure.
Figure 7C:
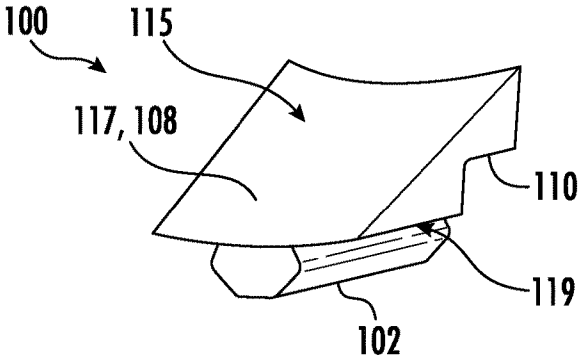
FIG. 7C is a perspective view of another fan retention member for a fan assembly in accordance with an exemplary aspect of the present disclosure.

Referring particularly now to FIGS. 7A and 7B, in at least some embodiments, the fan retention member 100 may include a body portion 115 having, at least, a first surface 117 and a second surface 119. Thus, as shown particularly in FIG. 7A, the first surface 117 defines the flowpath surface 108 described herein, whereas the second surface 119 defines the flange 110 described herein. Moreover, as shown particularly in FIG. 7B, the flowpath surface 108 may be generally defined by a central region 121 and at least one wing 116. In particular embodiments, as shown in FIG. 7B, the flowpath surface 108 may be generally defined by the central region 121 and a pair of wings 116 extending from opposing sides of the central region 121. Thus, as shown in FIG. 7B, the wing(s) 116 are configured to rest or sit upon a respective disk post 96 (FIG. 6A) of the plurality of disk posts 96 when the protrusion 102 of the fan retention member 100 is received within the post slot 95 (FIG. 6A) of the disk post 96. Accordingly, the pair of wings 116 can help support the platforms 86, e.g., by supporting the platforms 86 along the circumferential direction C.

In certain embodiments, as shown particularly in FIG. 7B, one or more of the wings 116 of the fan retention member 100 may be configured to fail under certain loading conditions, e.g., to limit or minimize damage to the fan assembly 15 (FIG. 3) and/or components of the turbofan engine 10 (FIG. 1) surrounding or downstream of the fan assembly 15 (FIG. 3) in the event of a breakage and/or failure of a fan blade 40 and/or platform 86. For instance, at least one wing 116 of the pair of wings 116 may be formed from a first material and a remainder of the fan retention member 100

(such as the central region 121, the flange 110, and/or the protrusion 102) may be formed from a second material. In such embodiments, for example, the first material may have a lower stiffness than the second material. As such, under particular loading conditions, one or more of the wings 116 may be crushed (or the like) to assist in preventing damage to or failure of other components of the fan assembly 15 or turbofan engine 10. The first material and the second material may be any appropriate composite materials, metal materials, alloys, or the like as discussed in greater detail herein.

Figure 9A:
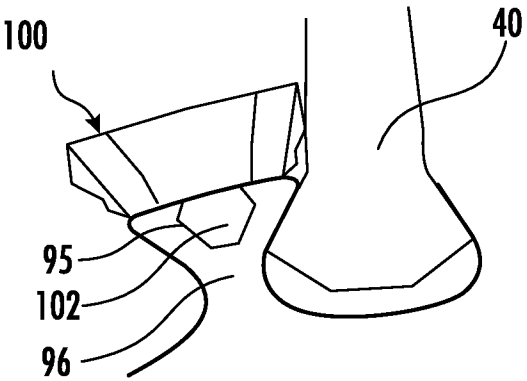
FIGS. 9A-9C are schematic views of a disk post and a slot defined in a disk of a fan assembly in accordance with exemplary aspects of the present disclosure.
Figure 9B:
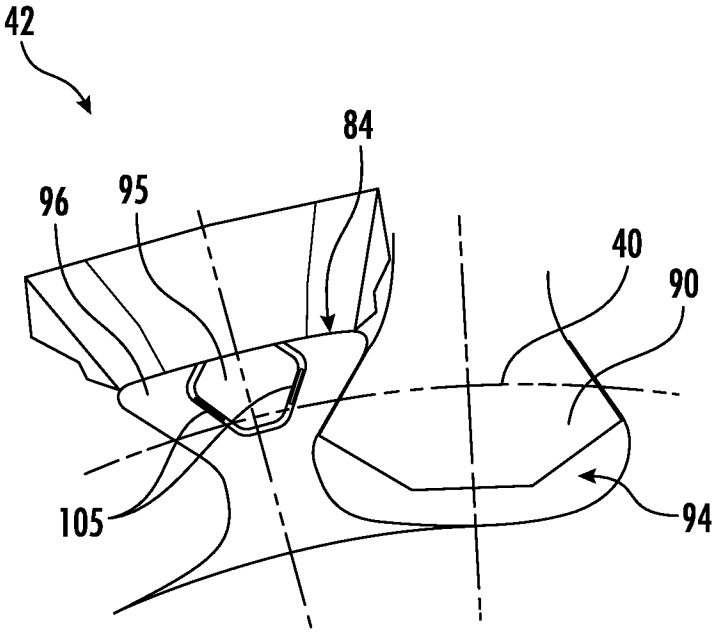
Figure 9C:
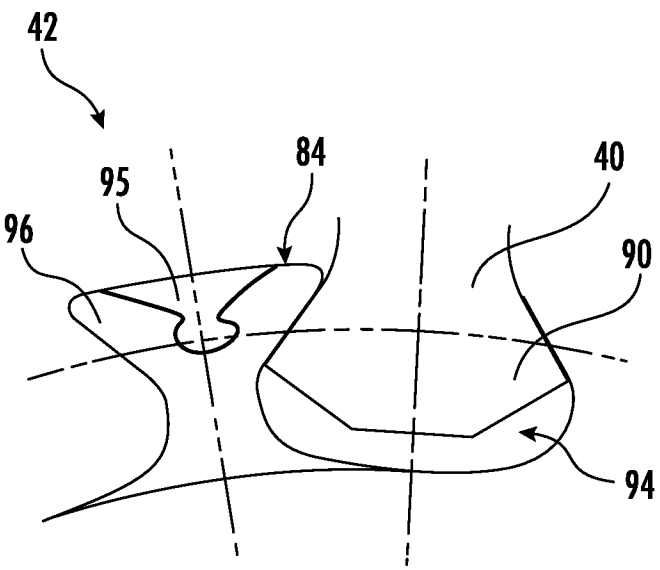

Referring to FIGS. 9A-9C, schematic views of different embodiments of one of the disks post 96 and an adjacent fan blade 40 according to the present disclosure are provided. In particular, as shown, the blade root 90 of the fan blade 40 is received with one of the plurality of disk slots 94 of the disk 42. Furthermore, as shown in FIG. 9A, the protrusion 102 of the fan retention member 100 is received within the post slot 95 of the disk post 96. Thus, as shown, the shape of the post slot 95 of the disk post 96 can have any suitable shape. For example, as shown in FIGS. 9A and 9B, the post slot 95 of the disk post 96 may have a generally hexagonal shape. Moreover, in an embodiment, as shown in FIG. 9C, at least a portion of the post slot 95 of the disk post 96 may have an arcuate profile. Accordingly, each of the protrusions 102 of the fan retention members 100 have a corresponding or complementary shape that is received and secured within each of the post slots 95 of the disk posts 96. In still further embodiments, the post slots 95 of the disk posts 96 and the corresponding protrusions 102 of the fan retention members 100 may have a dovetail configuration or any other suitable complementary or matching shapes.

In further embodiments, as shown in FIG. 9B, one or more shims 105 arranged between contact regions of the at least one fan retention member and the post slots.

In additional embodiments, the fan retention member 100 may be formed from any appropriate material, such as a composite, a metal, or an alloy, including a shape memory alloy (SMA). For example, in an embodiment, the fan retention member 100 may be formed from a polymer matrix composite (PMC) material having reinforcing material (e.g., reinforcing fibers) surrounded by a polymer matrix phase.

In addition, in some embodiments, as shown in FIG. 7A, the fan retention member 100 may be a single, unitary component. In alternative embodiments, the fan retention member 100 may be segmented into a plurality of segments that, when arranged and secured together, form the fan retention member 100.

Figure 10:
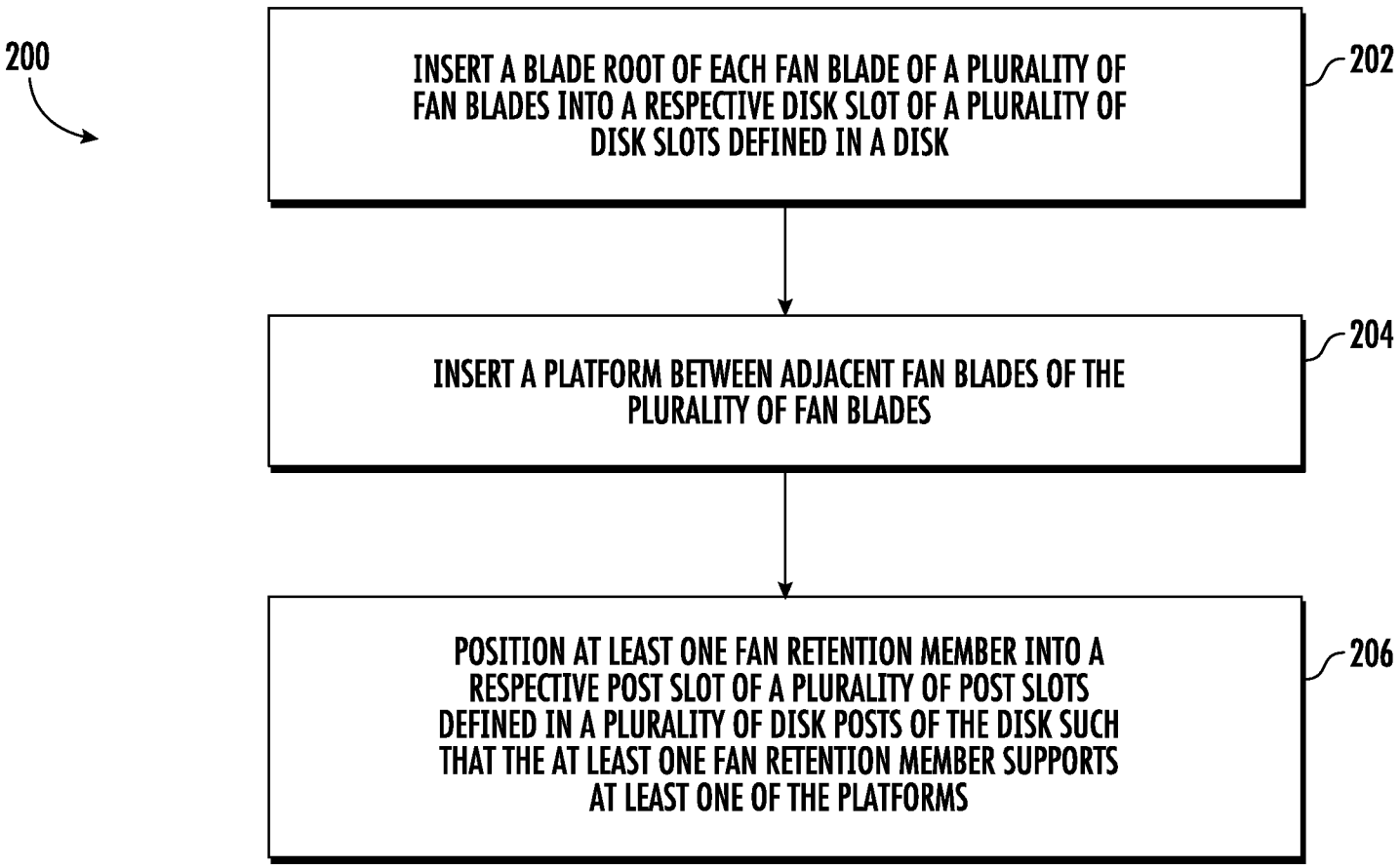
FIG. 10 is a flow diagram illustrating a method for assembling a fan assembly in accordance with an exemplary aspect of the present disclosure.

Referring now to FIG. 10, a flow diagram of a method 200 for assembling a fan assembly in accordance with an exemplary aspect of the present disclosure is provided. The method 200 of FIG. 10 may be utilized to form one or more of the exemplary fan assemblies 15 described above with reference to FIGS. 1 through 9C. Accordingly, it will be appreciated that the method 200 may generally be utilized to assemble a fan assembly including a fan retention member received in a rotor disk to support platforms of fan blades of the fan assembly. However, in other exemplary aspects, the method 200 may additionally or alternatively be utilized to assemble any other suitable fan assembly. In addition, although FIG. 10 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As depicted, the method 200 includes at (202) inserting a blade root of each fan blade of a plurality of fan blades into a respective disk slot of a plurality of disk slots defined in a disk. The method 200 further includes at (204) inserting a platform between adjacent fan blades of the plurality of fan blades. The method 200 further includes at (206) positioning at least one fan retention member into a respective post slot of a plurality of post slots defined in a plurality of disk posts of the disk such that the at least one fan retention member supports the platform. The fan retention member(s) defines a flowpath surface that is positioned at a radially outer surface of the disk at a disk forward edge. The fan retention member may include a forward edge positioned at the radially outer surface of the disk, e.g., at or adjacent a disk forward surface.

Although described herein with respect to a fan assembly including a plurality of fan blades attached to a rotor disk with a plurality of platforms extending between the fan blades, it will be appreciated that the present disclosure, including the fan retention member described herein, may be useful in other assemblies as well. For instance, a fan retention member as described herein may be used in other rotor assemblies, such as compressor rotor blade or turbine rotor blade assemblies.

Further aspects are provided by the subject matter of the following clauses:

A fan assembly, the fan assembly circumferentially arranged about a longitudinal centerline extending along an axial direction, the fan assembly defining a radial direction perpendicular to the axial direction, the fan assembly comprising: a disk having a disk forward surface, a disk aft surface, and a radially outer surface, the disk defining a plurality of disk posts and a plurality of disk slots in the radially outer surface, at least one of the plurality of disk posts comprising a post slot; a fan having a plurality of fan blades and a plurality of platforms extending between adjacent fan blades of the plurality of fan blades, each of the plurality of fan blades received within one of the plurality of disk slots via a respective blade root; and at least one fan retention member comprising a body portion and a protrusion extending from the body portion, the protrusion received within the post slot such that the at least one fan retention member supports one of the plurality of platforms.

The fan assembly of any preceding clause, wherein each fan blade of the plurality of fan blades defines a blade tip radially opposite a blade root, wherein a hub radius of the fan assembly is defined along the radial direction from the longitudinal centerline to an interface of a leading edge of the fan blade, wherein a tip radius is defined along the radial direction from the longitudinal centerline to the blade tip of a respective fan blade of the plurality of fan blades, wherein a fan radius ratio is defined as a ratio of the hub radius to the tip radius, and wherein the fan radius ratio is minimized to a range of 0.20 to 0.35.

The fan assembly of any preceding clause, wherein the forward edge of the at least one fan retention member is positioned at the radially outer surface of the disk such that the hub radius is within 10% plus or minus of a disk radius defined along the radial direction from the longitudinal centerline to the radially outer surface of the disk.

The fan assembly of any preceding clause, wherein the forward edge of the at least one fan retention member is disposed at the disk forward surface.

The fan assembly of any preceding clause, wherein each platform of the plurality of platforms has a platform forward surface offset from the disk forward surface along the axial direction, and wherein the at least one fan retention member comprises a flowpath surface extending from a forward edge of the at least one fan retention member to the platform forward surface.

The fan assembly of any preceding clause, wherein the at least one fan retention member further comprises a pair of wings extending from opposing sides of a central region of a body portion.

The fan assembly of any preceding clause, wherein at least one wing of the pair of wings is formed from a first material and a remainder of the at least one fan retention member is formed from a second material, and wherein the first material has a lower stiffness than the second material.

The fan assembly of any preceding clause, wherein the at least one fan retention member is formed, at least in part, from a polymer matrix composite (PMC) material.

The fan assembly of any preceding clause, wherein the at least one fan retention member is a single, unitary component.

The fan assembly of any preceding clause, wherein the at least one fan retention member further comprises a flange extending along the axial direction, the flange being spaced apart from the protrusion along the radial direction such that a gap is defined between the flange and the protrusion.

The fan assembly of any preceding clause, wherein each platform of the plurality of platforms comprises a platform flange that is received in the gap.

The fan assembly of any preceding clause, wherein the platform flange of each platform of the plurality of platforms and the flange of the at least one fan retention member are disposed at an axial location that is aft of the disk forward surface.

The fan assembly of any preceding clause, wherein the protrusion has a shape that is complementary to a shape of the post slot.

The fan assembly of any preceding clause, wherein each disk post of the plurality of disk posts extends along the radial direction between two adjacent disk slots.

The fan assembly of any preceding clause, wherein a flowpath surface of the at least one fan retention member has a shape or contour comprising one or more scoops such that the flowpath surface dips radially inward toward the longitudinal centerline.

The fan assembly of any preceding clause, further comprising one or more shims arranged between contact regions of the at least one fan retention member and the post slots.

A fan retention member for supporting a platform of a fan assembly, the fan retention member comprising: a body portion comprising, at least, a first surface and a second surface, the first surface defining an airflow surface, the second surface defining a flange; at least one wing extending from a central region of the body portion; a protrusion extending from the second surface, the flange spaced apart from the protrusion such that a gap is defined between the flange and the protrusion, and wherein the protrusion defines a shape configured for receipt within a post slot of a disk post of a disk of the fan assembly such that, when the protrusion is received within the post slot, the body portion supports the platform.

The fan assembly of any preceding clause, wherein the fan retention member is a single, unitary component.

The fan assembly of any preceding clause, further comprising a pair of wings extending from opposing sides of the second surface, the at least one wing being one of the pair of wings.

The fan assembly of any preceding clause, wherein at least one wing of the pair of wings is formed from a first material and a remainder of the fan retention member is formed from a second material, and wherein the first material has a lower stiffness than the second material.

The fan assembly of any preceding clause, wherein the fan retention member is formed, at least in part, from a polymer matrix composite (PMC) material.

A method for assembling a fan assembly, comprising: inserting a blade root of each fan blade of a plurality of fan blades into a respective disk slot of a plurality of disk slots defined in a disk; inserting a platform between adjacent fan blades of the plurality of fan blades; positioning at least one fan retention member into a respective post slot of a plurality of post slots defined in a plurality of disk posts of the disk such that the at least one fan retention member supports the platform, wherein the at least one fan retention member defines a flowpath surface that is positioned at a radially outer surface of the disk at a disk forward edge.

This written description uses examples to disclose the present disclosure, including the best mode, and also to enable any person skilled in the art to practice the disclosure, including making and using any devices or systems and performing any incorporated methods. The patentable scope of the disclosure is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

We claim:

1. A fan assembly, the fan assembly circumferentially arranged about a longitudinal centerline extending along an axial direction, the fan assembly defining a radial direction perpendicular to the axial direction, the fan assembly comprising:

a disk having a disk forward surface, a disk aft surface, and a radially outer surface, the disk defining a plurality of disk posts and a plurality of disk slots in the radially outer surface, at least one of the plurality of disk posts comprising a post slot;

a fan having a plurality of fan blades and a plurality of platforms extending between adjacent fan blades of the plurality of fan blades, each of the plurality of fan blades received within one of the plurality of disk slots via a respective blade root; and at least one fan retention member comprising a body portion and a protrusion extending from the body portion, the protrusion received within the post slot such that the at least one fan retention member retains one of the plurality of platforms to the at least one of the plurality of disk posts such that a platform forward surface of the one of the plurality of platforms is spaced aft of a respective leading edge of each of the plurality of fan blades and aft of the disk forward surface, the body portion extending out from the post slot adjacent a radially outermost surface of the at least one of the plurality of disk posts, wherein the at least one fan retention member defines a forward edge that is disposed at an axial position of the disk forward surface, wherein the at least one fan retention member further comprises a pair of wings extending from opposing sides of a central region of a body portion, wherein at least one wing of the pair of wings is formed from a first material and a remainder of the at least one fan retention member is formed from a second material, and wherein the first material has a lower stiffness than the second material.

2. A fan retention member for supporting a platform of a fan assembly, the fan retention member comprising:

a body portion comprising, at least, a first surface and a second surface, the first surface defining an airflow surface, the second surface defining a flange;

a forward edge;

at least one wing extending from a central region of the body portion;

a protrusion extending from the second surface, the flange spaced apart from the protrusion such that a gap is defined between the flange and the protrusion, and wherein the protrusion defines a shape configured for receipt within a post slot of a disk post of a disk of the fan assembly such that, when the protrusion is received within the post slot, the body portion supports the platform, wherein, when the protrusion is received within the post slot of the disk post, the forward edge is disposed at an axial position of a disk forward surface of the disk and aft of a leading edge of a fan blade, wherein the airflow surface meets a platform forward surface of the platform at an axial position aft of the disk forward surface, wherein the fan retention member further comprises a pair of wings extending from opposing sides of the second surface, the at least one wing being one of the pair of wings, wherein at least one wing of the pair of wings is formed from a first material and a remainder of the fan retention member is formed from a second material, and wherein the first material has a lower stiffness than the second material.

* * * * *